US005377907A

United States Patent [19]

Guard

[11] Patent Number: 5,377,907

[45] Date of Patent: Jan. 3, 1995

[54] ASSEMBLY FOR HOUSING MULTIPLE WASTE RECEPTACLES

[76] Inventor: Paul P. Guard, 3327 SE. 18th Ave., Cape Coral, Fla. 33904

[21] Appl. No.: 950,458

[22] Filed: Sep. 24, 1992

[51] Int. Cl.[6] ..... B65D 91/00; B07C 5/00

[52] U.S. Cl. ..... 232/43.2; 209/702; 209/930; 209/942; 220/525; 220/909; 312/140

[58] Field of Search ..... 209/702, 930, 933, 706, 209/630, 942; 220/23.86, 335, 336, 524, 909, 525, 622; 296/56; 280/47.26, 79.11; 232/43.1, 43.2, 525, 622; 312/140

[56] References Cited

U.S. PATENT DOCUMENTS

| | | | |
|---|---|---|---|
| 3,395,859 | 8/1968 | Menges | 232/43.2 |
| 3,573,879 | 4/1971 | Bergkamp et al. | 280/47.19 |
| 3,666,169 | 5/1972 | Eaton | 280/47.19 X |
| 3,893,615 | 7/1975 | Johnson | 232/43.2 |
| 4,235,047 | 11/1980 | Turner | 296/56 X |
| 4,905,853 | 3/1990 | Strawder | 220/909 X |
| 5,044,644 | 9/1991 | Duran et al. | 280/47.35 |
| 5,076,458 | 12/1991 | Weiner et al. | 232/43.2 X |
| 5,111,927 | 5/1992 | Schulze, Jr. | 209/930 X |
| 5,118,037 | 6/1992 | Ekegren | 232/43.2 X |
| 5,152,420 | 10/1992 | Bird et al. | 220/909 X |

FOREIGN PATENT DOCUMENTS

| | | | |
|---|---|---|---|
| 1473413 | 3/1967 | France | 232/43.2 |
| 1012559 | 7/1957 | Germany | 220/909 |
| 3501626 | 7/1986 | Germany | 220/909 |

*Primary Examiner*—D. Glenn Dayoan
*Assistant Examiner*—Tuan N. Nguyen
*Attorney, Agent, or Firm*—William E. Noonan

[57] ABSTRACT

An assembly is provided for housing multiple waste receptacles. The assembly includes a generally hollow enclosure that has a floor portion, a pair of spaced apart side portions attached to and extending upwardly from the floor portion, a rearward portion interconnecting the side portions and an opening into the interior of the enclosure, which opening extends between the floor portion and an upper edge region of the rearward portion and further extends between the side portions. A door is hingedly connected to at least one of the upper edge region of the rearward portion and side portions. The door is selectively raised to expose the opening, whereby waste receptacles may be introduced into and removed from the enclosure, and lowered to generally close the opening. The door has a plurality of drop holes in communication with corresponding waste receptacles in the enclosure for receiving waste therethrough and directing the waste to the corresponding waste receptacles.

15 Claims, 4 Drawing Sheets

ASSEMBLY FOR HOUSING MULTIPLE WASTE RECEPTACLES

FIELD OF THE INVENTION

This invention relates to an assembly for housing a plurality of waste receptacles and, in particular, to a durable and attractive enclosure for accommodating recycling bins and multiple users'refuse containers.

BACKGROUND OF THE INVENTION

Multiple trash and garbage receptacles are employed by a variety of establishments, including condominiums, apartment complexes, RV and mobile home parks, marinas and shopping centers. In recent years, the use of such containers has increased in popularity due to recycling programs wherein various types of recyclable material are segregated into appropriate barrels or bins. Unfortunately, whenever multiple waste receptacles are employed, a number of problems often result. In particular, exposed containers are typically very unattractive. Moreover, the containers can become separated and fall over thereby further contributing to a messy appearance. Unprotected receptacles are also susceptible to theft. And, when refuse containers are exposed to the elements, trash and garbage can become soaked and strewn about by wind, rain and snow.

Segregating refuse containers for recycling presents additional difficulties. Very often the containers are marked poorly or not at all. As a result, different types of recyclables are often mixed together in the same bin and must be sorted by the hauler. Collection is further complicated because haulers normally must stop at each residential or business location.

Various enclosures are known for storing multiple refuse and recycling bins. However, these products do not permit convenient collection of these waste materials. One conventional model employs a clamshell construction wherein a hood is hingedly connected to a tub-like base. Drop holes are provided in the hood for depositing refuse in respective bins or barrels placed in the base. When the individual barrels are filled, the hood is opened and the barrels are lifted manually out of the base. This can be a time consuming and physically demanding operation. Additionally, the drop holes in the enclosure are open to the elements so that rain is liable to enter the device and soak the deposited refuse. Moreover, most known enclosures for multiple waste receptacles have a relatively small refuse capacity.

SUMMARY OF INVENTION

It is therefore an object of the present invention to provide an assembly, which houses multiple waste receptacles such that the receptacles may be quickly and conveniently handled to collect the refuse deposited therein.

It is a further object of this invention to provide an assembly for housing multiple waste receptacles that is both durable and attractive;

It is a further object of this invention to provide an enclosure assembly that hides multiple waste receptacles from view but at the same time permits convenient individualized access to each of the receptacles for depositing refuse therein.

It is a further object of this invention to provide an enclosure, which effectively protects waste receptacles from rain, wind and other adverse weather conditions.

It is a further object of this invention to provide an assembly that is particularly effective for housing multiple waste receptacles of the type used in recycling programs and multiple user applications such as condominiums, apartment complexes and shopping centers.

It is a further object of this invention to provide an enclosure for multiple waste receptacles, which is compact but includes a large refuse capacity.

It is a further object of this invention to provide an enclosure for multiple waste receptacles, which is relatively easy to construct and install.

This invention features an assembly for housing multiple waste receptacles. The assembly includes a generally hollow enclosure having a generally flat floor portion, a pair of spaced apart side portions attached to and extending upwardly from the floor portion, a rear portion interconnecting the side portions and an opening into the interior of the enclosure. The opening extends between the floor portion and an upper edge region of the rearward portion and further extends between the side portions. A door is hingedly connected to at least one of the upper edge region of the rearward portion and the side portions. The door is selectively raised to expose the opening, whereby waste receptacles may be introduced into and removed from the enclosure, and lowered to generally close the opening. The door includes a plurality of drop holes in communication with corresponding waste receptacles in the enclosure for receiving waste therethrough and directing the waste to the corresponding waste receptacles.

In a preferred embodiment the enclosure includes upper and lower molded sections and means for joining the molded sections. The rearward portion may include a back wall segment and a roof segment that is attached to the back wall segment and includes the upper edge region of the rearward portion. The receptacles may include wheels and the floor portion may include a ramp formed along a forward edge thereof adjacent to the opening for permitting the receptacles to be wheeled into and out of the enclosure. The rearward enclosure portion may also include a second plurality of drop holes that communicate with a second group of corresponding waste receptacles in the enclosure for receiving waste therethrough and directing the waste to the corresponding waste receptacles in the second group.

A handle may be formed on the door for raising and lowering the door. Means may be provided for temporarily latching the door in the closed condition and means, responsive to engagement of the handle, may be provided for releasing the means for latching to raise the door and open the enclosure.

The enclosure may include an internal frame for increasing the rigidity of the enclosure. Means interconnecting the door and the side portions may be provided for releasably retaining the door in the raised condition. Such means for retaining may include piston means carried by one of the door and the side portions and pneumatic cylinder means carried by the other of the door and the side portions. The piston means and cylinder means may comprise a pair of gas struts, respectively.

The drop holes are preferably formed generally vertically in the door and, likewise, generally vertically in the rearward portion. The door may include a plurality of recesses formed therein for accommodating respective drop holes. Shelf means may be formed below each drop hole. Such shelf means are typically sloped downwardly when the door is closed to direct rainwater away from the corresponding drop holes. It is preferred that flap means be pivotably suspended from the door above a respective one of the drop holes for covering the drop hole when the door is closed. Such flap means are selectively opened relative to the drop hole to deposit refuse therethrough. The door may include a hood fixed to the door over a respective one of the drop holes for directing rainwater away from the drop hole. Shelf means may include a channel formed therein for collecting rainwater and prohibiting such rainwater from entering the corresponding drop hole. The shelf means may further include a lip proximate the drop hole for engaging a distal portion of the flap means to block rainwater from entering through the drop hole.

Appropriate wheels, such as casters, may be employed beneath the enclosure to facilitate movement of the assembly.

DISCLOSURE OF PREFERRED EMBODIMENTS

Other objects, features and advantages will occur from the following description of preferred embodiments and the accompanying drawings, in which.

Figure 1:
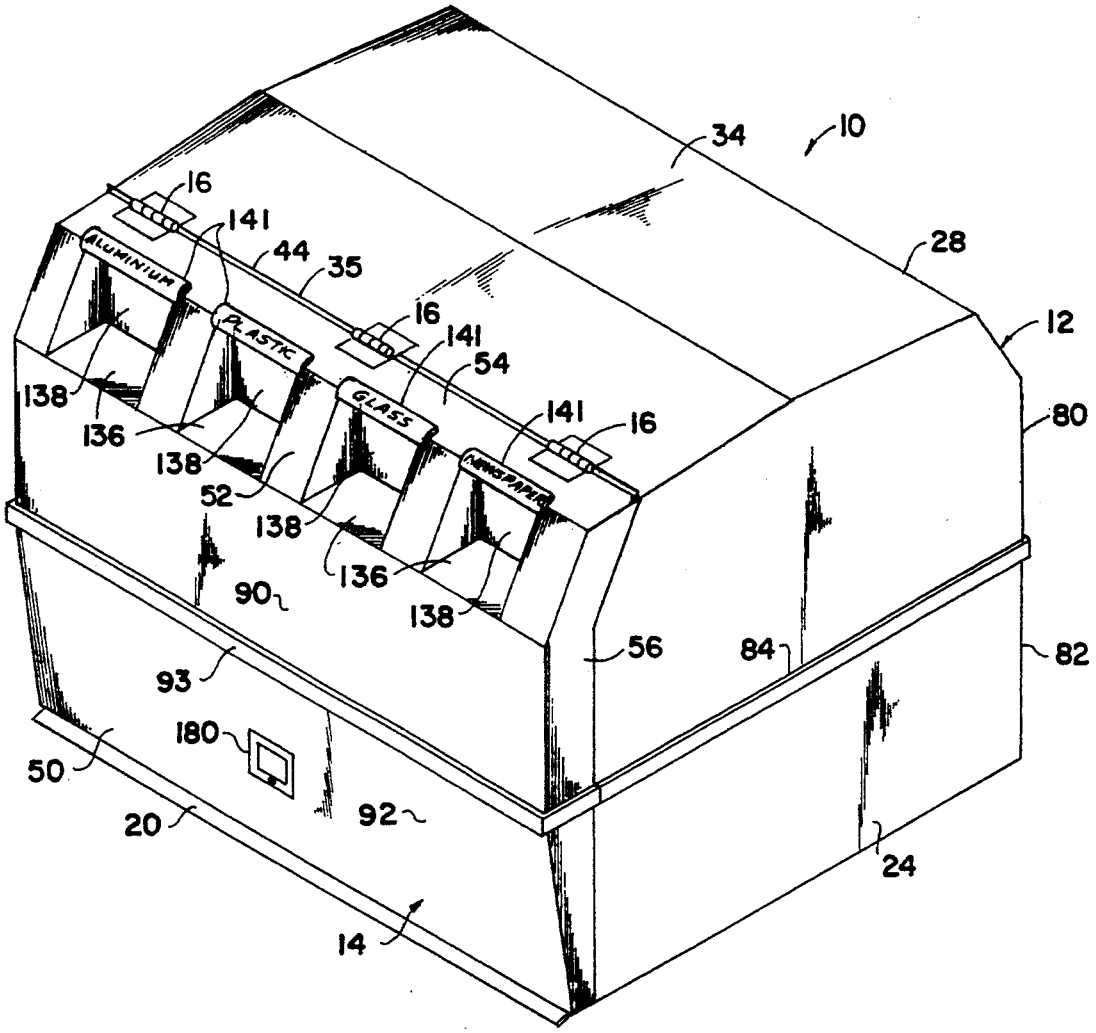
FIG. 1 is a front perspective view of an assembly for housing multiple waste receptacles in accordance with this invention, which assembly is in a closed condition.
Figure 2:
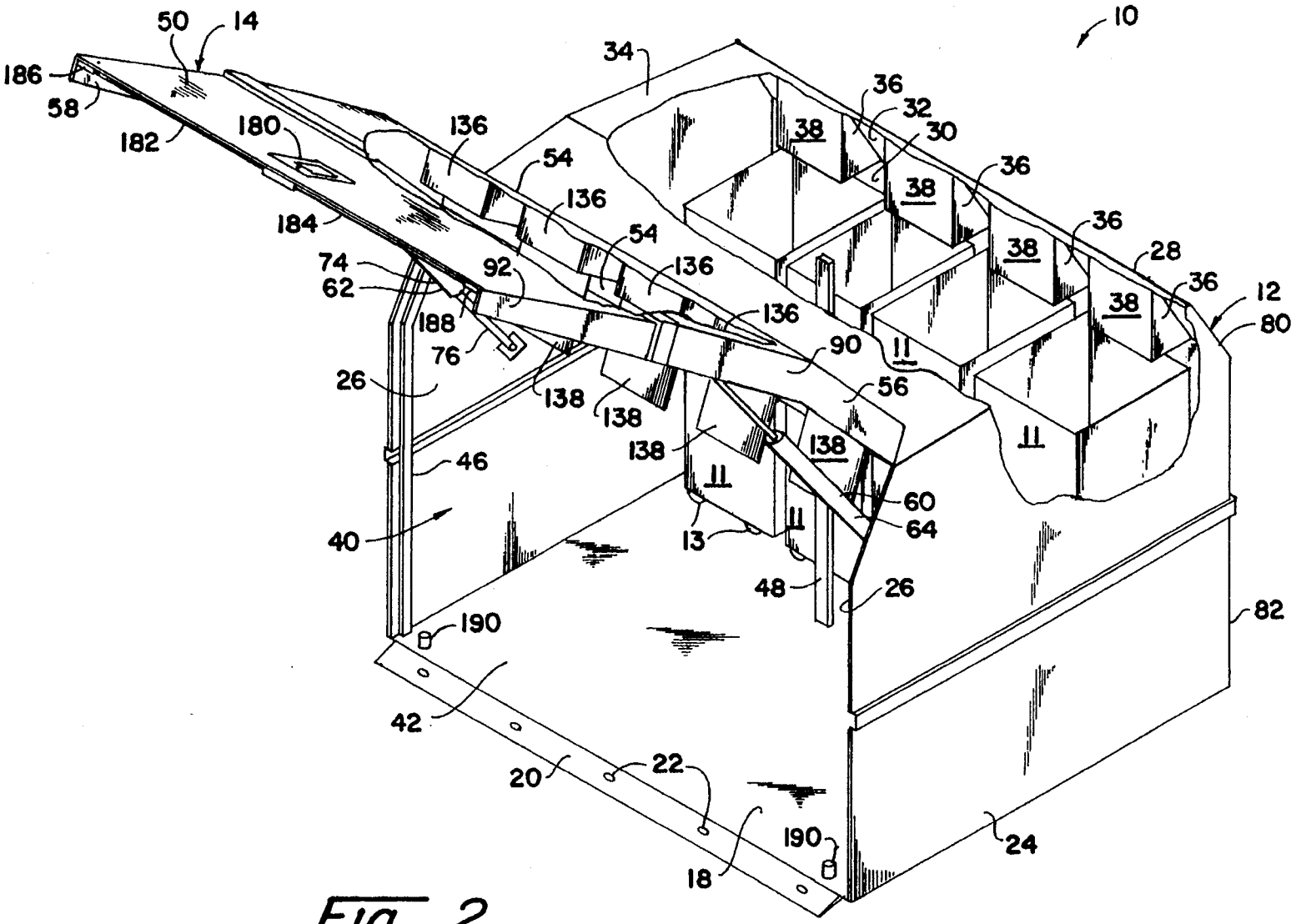
FIG. 2 is a perspective view of the assembly of FIG. 1 in an open condition exposing individual waste receptacles therein.
Figure 3:
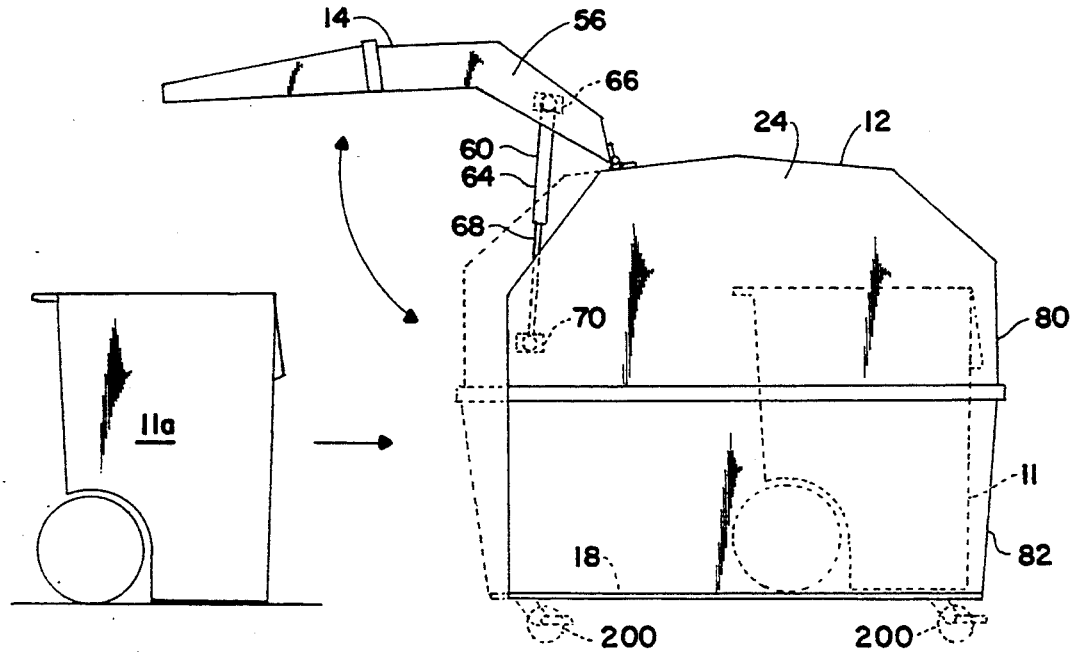
FIG. 3 is an elevational side view of the assembly in an open condition.

There is shown in FIGS. 1–3 an assembly 10 for housing a plurality of recycling receptacles 11. The assembly includes a generally hollow, molded enclosure 12 and a similarly molded front door 14 that is interconnected to enclosure 12 by means of hinges 16. FIG. 1 depicts door 14 in its closed condition and FIG. 2 illustrates the door in its open condition.

Enclosure 12 includes a generally flat floor section 18. A ramp 20 is secured to the forward edge of floor 18 by suitable means such as bolts 22 (FIG. 2). A pair of side wall sections 24 and 26 are secured integrally to opposite sides of floor section 18 and extend generally vertically upwardly therefrom. A rearward portion 28 integrally interconnects side portions 24 and 26. Rearward portion 28 includes a back wall segment 30 (visible only in FIG. 2), a segment portion 32 (also visible only in FIG. 2) and a generally horizontal roof segment 34. Segments 30, 32 and 34 are integrally interconnected. A rain gutter 35 is formed along an upper edge portion 44 of roof segment 34. A plurality of molded wedge shaped recesses 36 are formed in beveled portion 32 and a drop hole covered by a flap 38 is formed at the interior end of each such recess. The structure of such drop holes and flaps is described more fully below in connection with the drop holes utilized on the door.

Recycling receptacles 11 are received within the hollow interior 40 of enclosure 12 and are positioned beneath corresponding drop holes in rearward portion 28 for receiving recyclable waste deposited therethrough. Receptacles 11 are conventional recycling bins or trash containers that are mounted on appropriate casters or rollers 13. The positioning and operation of the receptacles are described more fully below.

The front of enclosure 12 includes an opening 42 that extends vertically between ramp 20 and upper edge region 44 of roof segment 34. Opening 42 further extends horizontally between side walls 24 and 26. A frame 46 composed of aluminum or similar rigid, yet lightweight material, is formed around the periphery of walls 24 and 26 and is secured thereto by bolts, rivets or other appropriate means. This increases the structural integrity of enclosure 12. The strength of the enclosure is improved still further through the employment of a support post 48 disposed generally centrally within interior 40 between floor 18 and roof segment 34. Post 48 is likewise composed of aluminum or similar material.

Door 14 includes a wall segment 50 that is generally vertical when the door is closed, as shown in FIG. 1. A beveled segment 52 is integrally connected to and extends upwardly from segment 50. A generally horizontal roof segment 54 is integrally interconnected to and extends from roof segment 52 of rearward portion 28. Door 14 further includes side segments 56 and 58 that are integrally interconnected to segments 50, 52 and 54 along the opposite ends thereof. More particularly, side segments 56 and 58 are formed generally perpendicularly to the remaining segments of door 14 and when the door 14 is closed as shown in FIG. 1, the side segments 56 and 58 mate with respective sides 24 and 26 of enclosure 12.

Hinges 16 interconnect roof segment 54 of door 14 and roof segment 34 of rearward portion 12. As a result, the door 14 may be raised and lowered relative to enclosure 12. Hinges 16 may comprise various known pivots or hinge elements that are known to those skilled in the art. In the lowered condition shown in FIG. 1 and in phantom in FIG. 3, door 14 covers the entire opening 42 so that access into the interior 40 of enclosure 12 is restricted. Conversely, when door 14 is raised, as shown in FIG. 2, access is provided to interior 40 so that bins 11 may be removed from and introduced into the enclosure. In alternative embodiments the door may be hingedly interconnected to side walls 24 and 26 by appropriate pivots.

Raising and lowering of door 14 is facilitated by the use of gas struts 60 and 62. Strut 60 is interconnected between side wall 24 and door 14. Strut 62 is similarly interconnected between the side wall 26 and door 14. More particularly, as illustrated in FIG. 3, strut 60 includes a pneumatic cylinder 64 that is pivotably connected by a conventional rotary bracket 66 to the inside surface of side segment 56 of door 14. Cylinder 64 receives a conventional piston 68 that is itself pivotably interconnected by a rotary bracket 70 to the inside surface of wall 24. In a like manner, strut 62 (FIG. 2) includes a pneumatic cylinder 74 that is pivotably interconnected to the inside surface of side segment 58. Cylinder 74 operably receives a piston 76 that is pivotably interconnected to the inside surface of enclosure wall 26. These gas struts operate in a known manner to cushion the raising and lowering of door 14. The use of the struts and lightweight material in the door eliminates the need to use pumps or other mechanisms to raise the door.

Figure 4:
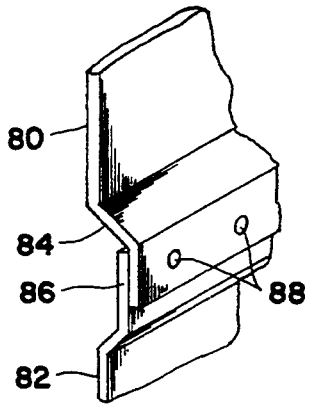
FIG. 4 is a partial perspective view of a preferred manner of interconnecting the upper and lower molded sections of the enclosure.

Molded enclosure 12 and door 14 are composed of suitable lightweight, yet rugged and weather resistant materials such as vacuum formed ABS plastic, acrylic or fiberglass. In the embodiment disclosed herein, both the enclosure and the door employ a pair of interconnected molded segments. For example, as illustrated in FIGS. 1 and 2, enclosure 12 includes an upper molded portion 80 and a lower molded portion 82. Portion 80, FIG. 4, includes a protruding rib 84 that overlaps an edge 86 of lower portion 82. Appropriate bolts or rivets 88 are formed through overlapping rib 84 and segment 86. Such bolts are formed about the entire enclosure such that the upper and lower sections 80 and 82 are securely interconnected. As shown in FIGS. 1 and 2, a rib 93 divides door 14 into upper and lower sections 90 and 92. Door 14 is an integral molded piece and rib 93 is formed to add rigidity and style to the door. Before the upper and lower sections are interconnected, the individual molded pieces 80, 82, and door 14 may be conveniently nested together for storage and shipping. In alternative embodiments the enclosure and door may comprise respective unitary pieces or may utilize other numbers of multiple interconnected pieces. The above manufacturing process is performed relatively quickly and inexpensively. The resulting enclosure is relatively lightweight and compact. For example, an enclosure 12 housing eight receptacles may be less than 500 lbs. and may occupy only sixty square feet. This specification may be varied within the scope of this invention.

Door 14 includes a plurality of wedge-shaped recesses 136 that are molded into beveled segment 52 of door 14. Each recess includes a drop hole 137, FIG. 5, formed at its inner end. As shown in FIG. 1, when the door is in its closed condition, a flap 138 covers the drop hole. A hood 141 is mounted over each drop hole in a manner described more fully below.

Figure 5:
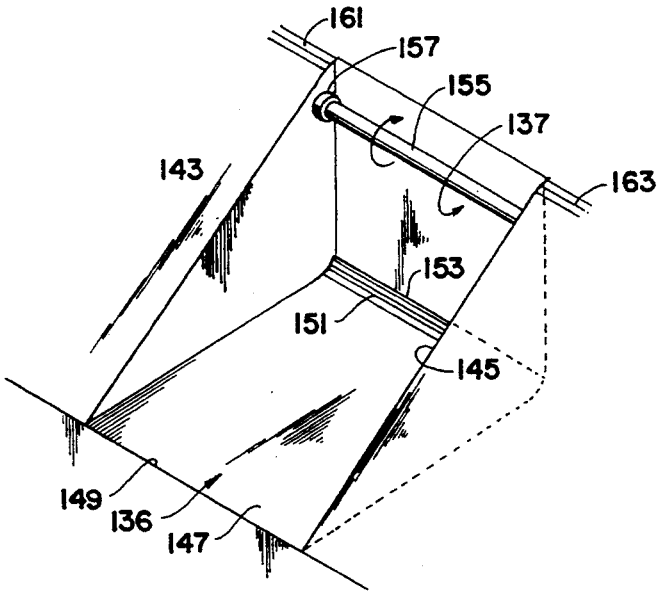
FIG. 5 is a perspective view of an individual representative drop hole of this invention, with the flap and hood removed for clarity.

As depicted in FIG. 5, each recess 136 (and analogously each recess in the rearward portion 28) includes a pair of side walls 143 and 145, as well as a shelf 147 that extends from the drop hole 137. Shelf 147 slopes generally downwardly from drop hole 137 so that water is effectively shed from the drop hole. The entry 149 to recess 136 is somewhat narrower than the width of the drop hole. This enables the drop holes and the door to be conveniently removed from the mold during manufacture of the assembly. A channel 151 is formed proximate the inner end of shelf 147 and a lip 153 extends upwardly therefrom. These features further improve the ability of the apparatus to direct rainwater away from the drop hole.

Figure 6:
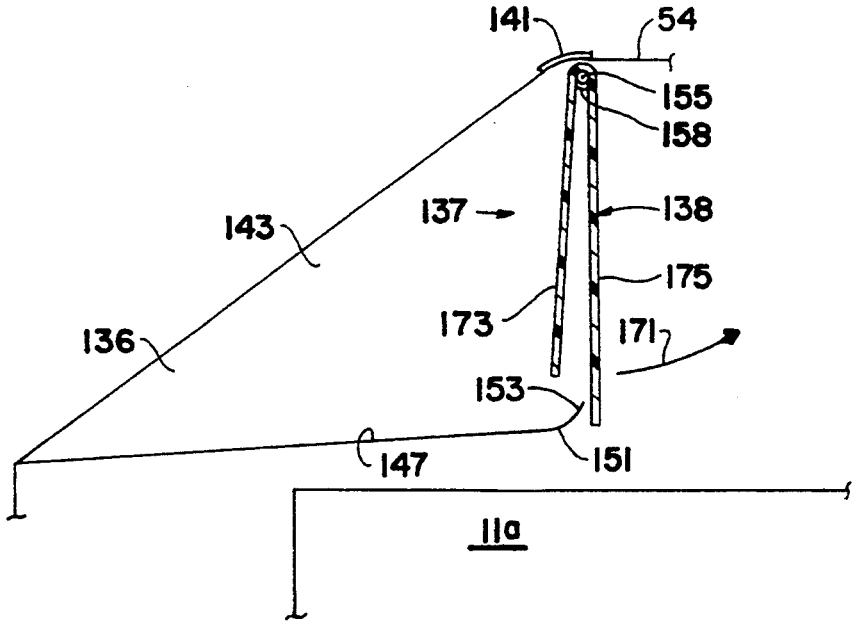
FIG. 6 is an elevational cross sectional view of an individual drop hole and its associated structure.

A rust-resistant metal or ABS plastic rod 155 is pivotably mounted in holes 157 formed in opposing walls 143 and 145. As best shown in FIG. 6, flap element 138 is secured to rod 155 by an ABS adhesive 157 or alternative attachment means. The flap element is draped over rod 155 and includes a relatively short outer section 173 that extends into recess 136 and a relatively long section 175 that hangs behind and below lip 153. When door 14 is closed, flap 138 is suspended downwardly from rod 155 due to the force of gravity such that section 175 of flap 138 engages lip 153. As a result, the flap is retained securely within the door and covers the drop hole 137. This prevents water and wind from entering assembly 10. Weather resistance is enhanced even more by hood 141, which is secured to the adjacent rounded edges 161 and 163 (FIG. 5) of door 14 by appropriate screws, rivets, adhesives or similar means. Hood 141 extends from roof segment 54 outwardly past the drop hole so that rain is shed away from the drop hole and onto the outwardly sloping shelf 147. Because the flap is closed by gravity, springs, latches and other intricate mechanisms are not required.

Rod 155 freely pivots in holes 157 so that flap 138 may be opened by pushing it rearwardly in the direction of arrow 171. Flap section 173 is short enough to clear lip 153 as the flap is opened. A respective recycling bin or other waste receptacle **11*a* is placed within the enclosure and just below each drop hole 137** so that appropriate refuse may be deposited through the drop hole and into the receptacle. After such a deposit is made, gravity returns the flap to its position covering the drop hole.

As shown in FIG. 1, each hood 141 may be marked or labeled to designate an appropriate type of recyclable material to be deposited in the drop hole beneath that hood. Alternatively, identifying residential or business designations may be applied to the hoods.

Figure 7:
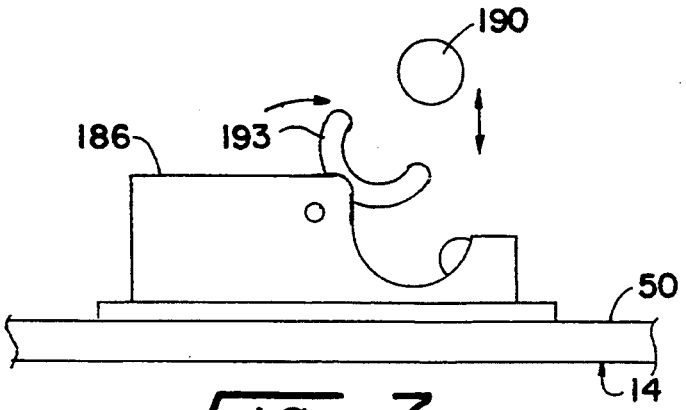
FIG. 7 is a top view of a representative door latch in an open condition.
Figure 8:
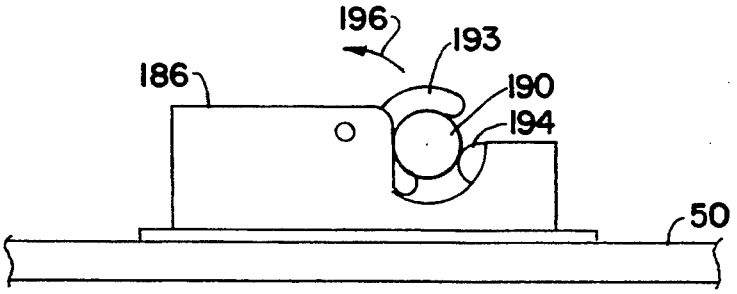
FIG.8 is a view similar to that of FIG. 7 of the door latch in its closed condition.

To assist the raising of door 14, a conventional handle 180, FIG. 1, is provided on the door. This handle may comprise a standard flush mounted paddle handle manufactured, for example, by Eberhard. The handle also serves to operate a latching system, which secures the door temporarily in its closed position. As shown in FIG. 2, handle 180 is interconnected by actuator arms 182 and 184 to respective latch elements 186 and 188. One of these latch elements 186 is shown alone in FIGS. 7 and 8. A similar construction is employed for latch 188. Each latch is mounted by bolts or other appropriate means to the inside surface of door wall segment 50. Latch 186 is a conventional rotary latch, of the type used to latch automobile doors. A representative latch of this type is again manufactured by Eberhard. To latch door 14 closed, a pair of striker pins 190 are formed in floor 18 (see also FIG. 2). The striker pins are positioned such that they are operably engaged by latches 186 and 188 when the door is closed. More particularly, as shown in FIG. 7, when door 14 is closed, a rotatable element 193 of latch 186 engages striker pin 190 and rotates into the closed position shown in FIG. 8. As a result, striker element 190 is secured between rotary element 193 and fixed element 194 of latch 186. Such engagement occurs between both of the latches 186 and 188 and their respective striker pins 190. This acts to hold the door in a securely closed position. An appropriate lock, known to those skilled in the art, may be provided in the handle 180 to prevent the door from being opened. The latches are disengaged by unlocking handle 180 and pulling the paddle handle apparatus. This pulls actuator arms 180 and 182, FIG. 2, which release the latches in a conventional manner. In particular, each rotary latch element 193 is pivoted open in the direction of arrow 196, FIG. 8. As a result, each striker pin 193 is released and the door 14 is permitted to open.

In operation, assembly 10 is transported to the desired location and, either prior to or following such transport, the molded enclosure sections 80 and 82 and molded door sections 90 and 92 are joined. The door is then pivotably mounted to the enclosure. After the assembly has been constructed and delivered, it is positioned for operation. To facilitate proper positioning and movement of assembly 10, casters or wheels 200 may be mounted to the bottom of the assembly, as shown in phantom in FIG. 3.

When assembly 10 is in position, door 14 is pivoted open, as shown in FIGS. 2 and 3. Next, the receptacles 11 and 11*a*, FIG, 3, are conventionally wheeled up ramp 20 and into the enclosure 12. Because there is no permanent wall formed across opening 42, the movement of bins 11 and 11*a* into and out of enclosure 28 is greatly facilitated. Time consuming and strenuous lifting is not required.

Four receptacles 11 are positioned respectively beneath the drop holes formed within recesses 36 in rearward portion 28. As with the drop holes in the door, the drop holes in the rearward portion may be appropriately labeled. Four receptacles 11*a* are similarly positioned proximate opening 42 so that they are located beneath respective drop holes 137 in door 14.

After the bins 11 and 11*a* are positioned beneath their corresponding drop holes, door 14 is lowered, latched and locked, as previously described. Assembly 10 is then used to efficiently receive and segregate recyclable material or other types of trash. Because the closed assembly remains locked, theft and loss of the receptacles is minimized. Moreover, the assembly presents a very attractive and neat appearance. And, as previously discussed, the various features employed with a drop hole resist weather intrusion. The molded plastic or fiberglass construction is both durable, weather resistant and easy to clean and maintain. After the various receptacles 11 and 11*a* have been filled, or at other scheduled intervals, door 14 is reopened and the receptacles are easily and conveniently wheeled out of the enclosure and collected by haulers and conventional trash collection and recycling equipment.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. An assembly for housing multiple rows of waste receptacles, said assembly comprising:

a generally hollow enclosure that includes a floor portion, a pair of spaced apart side portions attached to and extending upwardly from said floor portion, a rearward portion interconnecting said side portions, and an opening into the interior of said enclosure, which opening extends between said floor portion and an upper edge region of said rearward portion and further extends between said side portions; said rearward portion including a back wall segment and a roof segment that is connected to said back wall segment and includes said upper edge region of said rearward portion, said enclosure being sufficiently large to contain, between said back wall segment and said opening, forward and rearward rows of waste receptacles, each said row including a plurality of receptacles; and a door hingedly connected to at least one of said upper edge region of said rearward portion and said side portions; said door being selectively raised to expose said opening, whereby waste receptacles are introduced into and removed from said enclosure, and lowered to generally close said opening; said door including a first plurality of drop holes in communication with corresponding waste receptacles of said forward row for receiving waste therethrough and directing said waste to said corresponding waste receptacles in said forward row, said rearward enclosure portion including a second plurality of drop holes that communicate with corresponding waste receptacles in said rearward row for receiving waste therethrough and directing waste to said corresponding waste receptacles in said rearward row; said door further including a rod element pivotably mounted to said door and extending across said respective drop hole, and a flap element folded over and attached to said rod element for selectively opening and closing said respective drop hole, said flap element including a forward segment that is smaller than and pivots freely through said drop hole and a rearward segment that is larger than said drop hole and hangs inside of said door to close said respective drop hole when said door is closed.

2. The assembly of claim 1 in which said enclosure includes upper and lower molded sections and means for joining said molded sections.

3. The assembly of claim 1 in which said receptacles include wheels and said floor portion includes a ramp formed along a forward edge thereof and adjacent to said opening for permitting said receptacles to be wheeled into and out of said enclosure.

4. The assembly of claim 1 further including a handle formed on said door for raising and lowering said door.

5. The assembly of claim 4 further including means for temporarily latching said door in the closed condition and means, responsive to said handle, for releasing said means for latching to raise said door and open said enclosure.

6. The assembly of claim 1 in which said enclosure includes an internal frame for increasing the rigidity of said enclosure.

7. The assembly of claim 1 further including means interconnecting said door and said side portions for releasably retaining said door in said raised condition.

8. The assembly of claim 7 in which said means for retaining include piston means carried by one of said door and said side portions and pneumatic cylinder means carried by the other of said door and said side portions.

9. The assembly of claim 8 in which said piston means and cylinder means comprise a pair of gas struts interconnecting respective side portions of said enclosure and said door.

10. The assembly of claim 1 in which said drop holes are formed generally vertically in said door.

11. The assembly of claim 1 in which said door further includes a plurality of recesses formed therein for accommodating respective drop holes therein.

12. The assembly of claim 1 in which said door includes shelf means formed below each drop hole and being sloped downwardly when said door is closed to direct rainwater away from said corresponding drop hole.

13. The assembly of claim 12 in which said shelf means include a channel formed thereon for collecting rainwater and prohibiting such rainwater from entering said corresponding drop hole.

14. The assembly of claim 12 in which said shelf means include a lip proximate said drop hole for engaging a distal portion of said flap means to block rainwater from entering through said drop hole.

15. An assembly for housing multiple rows of waste receptacles, said assembly comprising:

a generally hollow enclosure that includes a floor portion, a pair of spaced apart side portions attached to and extending upwardly from said floor portion, a rearward portion interconnecting said side portions, and an opening into the interior of said enclosure, which opening extends between said floor portion and an upper edge region of said rearward portion and further extends between said side portions; said rearward portion including a back wall segment and a roof segment that is connected to said back wall segment and includes said upper edge region of said rearward portion, said enclosure being sufficiently large to contain, between said back wall segment and said opening, forward and rearward rows of waste receptacles, each said row including a plurality of receptacles; and a door hingedly connected to at least one of said upper edge region of said rearward portion and said side portions; said door being selectively raised to expose said opening, whereby waste receptacles are introduced into and removed from said enclosure, and lowered to generally close said opening; said door including a first plurality of drop holes in communication with corresponding waste receptacles of said forward row for receiving waste therethrough and directing said waste to said corresponding waste receptacles in said forward row, said rearward enclosure portion including a second plurality of drop holes that communicate with corresponding waste receptacles in said rearward row for receiving waste therethrough and directing waste to said corresponding waste receptacles in said rearward row: said door further including a hood fixed to said door over a respective one of said drop holes for directing rainwater away from said drop hole, a rod element pivotably mounted to said door and extending across said respective drop hole, and a flap element folded over and attached to said rod element for selectively opening and closing said respective drop hole, said flap element including a forward segment that is smaller than and pivots freely through said drop hole and a rearward segment that is larger than said drop hole and hangs inside of said door to close said respective drop hole when said door is closed.

* * * * *